US011028532B2

(12) United States Patent
Jarolim

(10) Patent No.: US 11,028,532 B2
(45) Date of Patent: Jun. 8, 2021

(54) DEVICE AND PROCESS FOR THE PRODUCTION OF NANOCELLULOSE

(71) Applicant: JAROLIM FASERTECHNIK GmbH, Gaspoltshofen (AT)

(72) Inventor: Michael Jarolim, Gaspoltshofen (AT)

(73) Assignee: JAROLIM FASERTECHNIK GmbH, Gaspoltshofen (AT)

( * ) Notice: Subject to any disclaimer, the term of this patent is extended or adjusted under 35 U.S.C. 154(b) by 0 days.

(21) Appl. No.: 16/971,271

(22) PCT Filed: May 8, 2019

(86) PCT No.: PCT/EP2019/061776
§ 371 (c)(1),
(2) Date: Aug. 19, 2020

(87) PCT Pub. No.: WO2020/015884
PCT Pub. Date: Jan. 23, 2020

(65) Prior Publication Data

US 2021/0002823 A1 Jan. 7, 2021

(30) Foreign Application Priority Data

Jul. 18, 2018 (AT) ..... A 50627/2018

(51) Int. Cl.
*D21B 1/34* (2006.01)
*D21H 11/18* (2006.01)

(52) U.S. Cl.
CPC ..... *D21B 1/342* (2013.01); *D21H 11/18* (2013.01)

(58) Field of Classification Search
CPC . D21B 1/342; D21B 1/34; D21B 1/14; D21B 1/30; D21B 1/26; D21H 11/18
(Continued)

(56) References Cited

U.S. PATENT DOCUMENTS 6,053,440 A 4/2000 LaRiviere
2014/0083634 A1* 3/2014 Bjoerkqvist ..... D21H 11/18 162/28

FOREIGN PATENT DOCUMENTS

CH 648071 A5 2/1985
DE 10066175 B4 8/2007
(Continued)

OTHER PUBLICATIONS

International Search Report and Written Opinion, issued in PCT/EP2019/061776 dated Aug. 20, 2019, 21 pages.
(Continued)

*Primary Examiner* — Jacob T Minskey
(74) *Attorney, Agent, or Firm* — Rothwell, Figg, Ernst & Manbeck, P.C.

(57) ABSTRACT

The invention pertains to a device and a process for the production of nanofibers, in particular, nanocellulose from a fiber-containing mixture of substances, whereby the device is formed including at least one discharge element with a discharge opening for the passage of a fiber-containing mixture of substances, at least one feeding device for the supply of the fiber-containing mixture of substances to the discharge element with a predeterminable process pressure, at least one positioning device for the positioning of the discharge element and whereby, for the disintegrating of the fiber-containing mixture of substances, a moveable processing body is arranged opposite relative to at least one discharge element whereby on the passage of the fiber-containing mixture of substances through the discharge element a slit-like processing area is formed between the discharge element and the substance mixture-affected partial surface of the moveable processing body.

20 Claims, 6 Drawing Sheets

(58) Field of Classification Search
USPC ..... 162/57
See application file for complete search history.

(56) References Cited

FOREIGN PATENT DOCUMENTS

| | | | |
|---|---|---|---|
| EP | 2659061 | B1 | 2/2015 |
| EP | 3088605 | A1 | 11/2016 |
| JP | H08-284090 | A | 10/1996 |
| JP | 2013-104142 | A | 5/2013 |
| WO | 2012/089930 | A1 | 7/2012 |
| WO | 2012/175806 | A2 | 12/2012 |
| WO | 2014/045209 | A1 | 3/2014 |
| WO | 2015/150628 | A1 | 10/2015 |
| WO | 2015/171714 | A1 | 11/2015 |

OTHER PUBLICATIONS

Austrian Office Action, issued in A 50627/2018 dated Jul. 18, 2018, 5 pages.
Austrian Office Action, issued in A 50627/2018 dated Aug. 24, 2018, 3 pages.

* cited by examiner

DEVICE AND PROCESS FOR THE PRODUCTION OF NANOCELLULOSE

CROSS REFERENCE TO RELATED APPLICATION

This application is a 35 U.S.C. 371 national phase entry application from PCT/EP2019/061776, filed May 8, 2019, which claims priority to Austrian Patent Application No. A 50627/2018, filed Jul. 18, 2018, the disclosures of which are incorporated herein in their entirety by reference, and priority is claimed to each of the foregoing.

BACKGROUND

Field of Invention

The invention concerns a device and a process for the production of nanofibers, especially, nanocellulose from a fiber-containing, primarily pulp and/or cellulose, mixture of substances.

Discussion of the Background

To date, a range of devices and methods have been developed for the production of nanofibers from natural raw materials, primarily from cellulose and/or pulp, for the production of nanocellulose. Amongst other things, micro- and/or nanofibers are distinguished between in specialist literature, whereby, numerous, different terms are used such as, for example, microfibrillated cellulose (MFC) or nanofibrillated fibers and/or nanofibrillated cellulose (NFC). Such materials are used increasingly in many technical fields, for example, as reinforcing materials or also even as barrier layers for paper, cardboard and similar items.

The processing of fibers, especially cellulose, is performed by fibrillation of the cell walls and exposure of the nanofibers, especially of nanocellulose. Consequently, the disintegrating takes place primarily along the length of the fibers and less through the shortening of the fibers in the cross direction.

Amongst other things, state-of-the-art microfluidizers are familiar in the production of nanocellulose. In a microfluidizer, such as in EP3088605A1, a primary fiber-containing fluid flow is crossed by a secondary fiber-containing fluid flow in order to cause the fibrillation of the cellulose into nanocellulose. Thereby, the fibers are led under high pressure through a microchannel with a fixed internal geometry in which, due to shear forces and impact effects, the cell walls of the fibers are broken open.

Another method for the production of nanocellulose can be implemented in the form of a homogenizer, such as revealed in JP201304142A1. In doing so, a fiber-containing substance mixture is pressed by means of high pressure through a valve seat in order to be then pressed radially through a microns-only wide homogenization gap and subsequently against a radially arranged impact ring. The action of such a high-pressure homogenizer is based on the shearing of the fibers through the changes in the speed of the fluid, the impact loads on the impact ring and on cavitation.

It is also possible to produce nanocellulose by means of a refiner or also a grinding machine as, for example, revealed in WO2013072558A 1. With refiners, normally two grinding plates connected to each other are guided together up to a grinding gap and a fiber-containing substance mixture is pressed in the centre of the grinding plates. The counter movement of the fully wetted grinding plates enables the disintegrating of fibers into nanofibers.

SUMMARY

The previously known methods and/or devices require a high energy input and are inclined to process interruptions due to blockages in narrow places such as valve seats, channels, nozzles and the like. Furthermore, known devices are not suitable for the processing of large volumes of fiber-containing substance mixtures for the production of nanofibers, notably nanocellulose, with only a low energy input.

Within the scope of the following explanation, mainly examples from the paper and pulp industry are used to explain the principle of disintegrating of fibers into nanofibers. The device of the invention and the associated process, however, cannot only be used logically on plant fibers but analogously also on fiber-containing substance mixtures with animal origins, such as fibers from sea squirts, or synthetic origins.

The present invention's purpose is to overcome the disadvantages of the state-of-the-art of technology and to make available a device and a process by means of which a user is able to carry out the simple, energy-efficient and practical disintegrating of the fibers of a substance mixture, in particular those of cellulose, for the production of, primarily, nanocellulose. Other purposes of the invention are to increase the process reliability, to minimize blockages or even to avoid them completely, and to be able to process large quantities of fiber-containing substance mixtures, especially pulp. Moreover, the invention forms the basis for the increasing of the homogeneity of the processed substance mixture and/or the guaranteeing of continuous production.

These purposes are met by means of a device and a process in accordance with the claims.

In accordance with the invention, the fibers to be disintegrated, especially cellulose or also pulp, are made available in the form of a substance mixture with a liquid component, notably water. The substance mixture can have a dispersion of fibers with different diameters and/or lengths. Previously disintegrated fibers can also be contained in the substance mixture. The fibers to be disintegrated can include a large number of micro-fibrils that typically have a diameter of 10 to 100 nm and a length of 0.5 to 10 μm.

Within the scope of the present invention, nanofibers are primarily understood to be elongated component parts of fibers and/or micro-fibrils that have a thickness direction or also a diameter in the range of some 5 to 30 nm and a significantly greater elongation. This relationship of elongation to nanofiber thickness can be expressed as the "aspect ratio" and is usually greater than 50.

The device according to the invention for the production of nanofibers, primarily of nanocellulose, from a fiber-containing substance mixture includes at least one discharge element with a discharge opening for the passage of a fiber-containing mixture of substances, at least one supply unit for the supply of the fiber-containing mixture of substances to the discharge element with a predeterminable process pressure and at least one positioning device for the positioning of the discharge element. For the disintegrating of the fiber-containing mixture of substances, a moveable processing body is arranged opposite relative to at least one discharge element, whereby on the passage of the fiber-containing mixture of substances through the discharge element a slit-like processing area is formed between the discharge element and the substance mixture impacted partial surface of the moveable processing body.

The process according to the invention makes use of such a device and includes the process steps:

Preparation of the invention-related device;

Preparation of the substance mixture that contains at least one liquid component, preferably water, and fibers, preferably pulp;

Movement of the moveable processing body relative to at least one discharge element at a predeterminable relative speed;

The pressing of the fiber-containing substance mixture through at least the one discharge element with a predeterminable process pressure;

Processing of the substance mixtures through the formation of a slit-like processing area for the disintegrating of fibers between the discharge element and a substance mixture loaded partial surface (a partial surface on which the substance mixture acts) of the moveable processing body through the positioning of the discharge element relative to the moveable processing body.

Through the relative movement of the processing body relative to the discharge element and, therefore, also the discharge opening, a shear field is generated at least in the slit-like formed processing area. The predeterminable process pressure creates a change in speed of the fluid, respectively the substance mixture, in the processing area and allows the continuous flow through of the substance mixture, the fibers of which are disintegrated in the shear field through the separation of the cell walls. In the process, long and/or insufficiently disintegrated, respectively processed, fibers and/or other disruptive material can be discharged from the processing area through the relative movement of the processing body and prevent the blockage of the device.

Thus, a relatively large amount of substance mixture can be processed and the homogeneity of the processed substance mixture can be increased.

Furthermore, the device according to the invention can be relatively simply and cost-efficiently manufactured and operated as complicated components are eliminated. Potential wear parts are relatively easy to access and can be replaced at a low cost, whereby the operating times can be significantly increased.

With known configurations, such as a refiner, a comparatively high no-load power for the movement of counter bodies, fully immersed in the substance mixture and moveable relative to each other, is necessary. The present invention distinguishes itself from the state-of-the-art technology especially simply in that a comparatively low partial surface of the processing body is affected by the substance mixture through which a particularly high energy efficiency can be achieved. The processed substance mixture is very greatly accelerated on leaving the processing area and can be collected in a simple way by a housing surrounding at least parts of the processing body and/or the discharge element. Thus, a part of the processing body is not in direct contact with the substance mixture. The processing body can, therefore, be moved with low resistance whereby the overall power consumption can be significantly reduced by the amount of the saved no-load power.

The device, and respectively the process according to the invention, are, therefore, outstandingly suitable for the processing of substance mixtures with synthetic and/or organic fibers. The proportion of fibers in the substance mixture can be chosen task-specific from approximately 0.1 to approximately 25 vol. %, preferably from 1 to 8 vol. %.

Through the substance discharge of the substance mixture on the discharge element on to a partial surface of the oppositely arranged processing body, a "passive" movement of the moveable processing body in the direction of motion can be initiated.

In addition, it can also be useful, when the moveable processing head is formed to be driveable, by means of a drive unit, in a movement direction, primarily sideways, preferable normal, to one of the discharge element axes of the discharge element.

This corresponds to an "active", and, therefore, a controllable movement of the moveable processing body in the direction of motion. The discharge element axis corresponds primarily to a specific longitudinal axis through the discharge element in the centre of the discharge opening. In the process, the movement takes place predominantly sideways, preferably normal, to the discharge element axis of the discharge element and can be initiated and controlled by means of the drive unit. In this way, the relative speed, and, therefore, the magnitude of the shear forces in the processing area can be relatively simply set.

In principle, it is also conceivable that the direction of motion of the moveable processing body can be essentially directed opposed to the direction of flow, at a specified angle to the substance-affected partial surface of the processing body, of the substance mixture.

In addition, it can also be designated that the moveable processing body rotation is formed symmetrically, similar to a disc, cylinder, cone or drum or band-shaped such as a chain or belt.

The selection of the geometry of the processing body can be done by a skilled person, taking into account the available spatial conditions, feed rate and drive power, etc. In certain cases, however, band-shaped processing bodies, where likewise only a part of the surface is in contact with the substance mixture, can be advantageous. The rotationally symmetric processing bodies also enable a relatively simple, task-related construction and, in addition, can be formed very dimensionally stable, without excessive energy expenditure, for the acceptance of the movement, as in each case only a substance affected partial surface is sprayed with the substance mixture.

Especially advantageous, too, is an arrangement in accordance with which it can be provided that the moveable processing body is formed as a disc, rotatable sideways, preferably normal, to the discharge element.

With the implementation as a disc or plate, the advantages of low-cost procurement, high service life and low maintenance expenditure can be exploited particularly well.

In addition, provision can be made that at least one positioning device is formed to move parallel to the rotation axis of the disc for the setting of the predeterminable radial distance of the discharge element axis from the axis of rotation.

This version allows an independent, or also an additional possibility, for the control of the relative speed in the processing area which, due to the various circumferential speeds in dependence on the radial distance to the rotation axis, can be set relatively easily. This measure, that especially with "passively" driven processing bodies provides an effective method of setting the shear forces, can be implemented supplementary to or instead of the rotational speed control of the drive unit.

According to further study, it is possible that the discharge element of the discharge opening has at least in part an extensive functional surface for the formation of a hydrodynamic bearing in the processing area. It is preferable that the discharge element is formed as one piece with the functional surface, but can, however, be made up of several parts and be formed approximately in the form of a replaceable end section of the discharge element.

The use of such an implemented discharge element allows the formation of a hydrodynamic bearing, whereby the discharge element can be spaced contact-free at a predeterminable operating distance from the substance mixture-affected partial surface. The substance mixture-affected partial surface corresponds in its shape and size essentially to the functional surface.

This allows in a simple way for the increase of the shear forces required for the crushing of the fibers, favourable pressures, such as the process pressure of the substance mixtures and/or the contact pressure of the discharge elements without the discharge element grinding on the processing body. The grinding of the discharge element and/or the functional surface can be avoided by, amongst other things, the formation of a fluid wedge in the processing area.

In addition, it can also be useful if the functional surface has a larger longitudinal extension in the direction of movement than in the cross section and/or against the direction of movement.

Through the optimization of the form of the functional surface, the homogenization of the substance discharge along the perimeter of the functional surface can be achieved. In this way, the stability of the hydrodynamic bearing can also be improved and the homogeneity and/or quality of the processed substance mixture can be improved.

In addition, provision can also be made so that the functional surface is formed complementary in shape to the substance mixture-affected partial surface of the moveable processing body.

Especially with curved inner and outer surfaces of the processing body, such as with a cylinder or a cone, the homogeneity of the substance mixture discharge out of the processing area, which forms an uneven substance mixture-affected partial surface, can be increased with this measure. This can significantly contribute to the homogenization over the functional area of the local discharge speeds and/or shear forces on the fibers to be processed in the processing area.

In addition, provision can be made so that at least one discharge element is formed to be adjustable in a predeterminable solid angle to the discharge element axis relative to the surface of the moveable processing body.

The advantages of this type of design lie in the adjustability and stabilization of the hydrodynamic bearing. Furthermore, the angular placement of the discharge element, especially with "passively" moved moving bodies, can be used for the setting of the relative speed and/or the shear forces in the processing area. This possibility is relatively easy and inexpensive to implement and enables an increase in the quality of the processed substance mixtures.

In accordance with a particular design, it is possible that the at least one positioning device for the setting of an operating distance and/or a solid angle between the at least one discharge element and the substance mixture-affected partial surface of the moveable processing body is formed as adjustable.

This can take place as a stand-alone measure or in combination with other measures, such as the angular placement or even the setting of the process pressure of the substance mixture.

In doing so, it can be particularly advantageous for the controlling of the relative speed of the moving processing body for the setting of the shear forces in the slit-like processing area. It can be similarly advantageous that the operating distance between the at least one discharge element and the corresponding substance mixture-affected partial surface for the setting of the compressive forces on the moving processing body is controlled at least by means of the positioning device.

Thus, for example, the contact pressure of the discharge elements can be precisely set and thereby be influenced by the discharge speed of the processed substance mixture, whereby, the level of the shear forces in the slit-like processing area can be precisely set.

In accordance with a favorable further study, provision can be made so that a solid angle of the discharge element axis of at least one discharge element, preferably for the formation of the necessary fluid wedge of the hydrodynamic bearing, is controlled by means of at least one positioning device.

Hereby, the level of the shear forces in the processing area can be precisely set. In addition, this measure can be used for the compensation of worn discharge elements and/or functional surfaces. This enables improved homogeneity and/or quality of the processed substance mixture over the operating time respectively service life of the wear parts.

It can be especially advantageous if an end section of at least one discharge element relative to the opposite lying substance mixture-affected partial surface is at least partially flexibly mounted.

The end section of the discharge element can include a functional surface, whereby a stabilization of the hydrodynamic bearing occurs. The end section can be formed essentially as freely moveable as a type of floating bearing arrangement for the discharge element or also as presettable, whereby, the compensation of wear on the discharge element and/or a functional surface is made possible. Furthermore, blockages through long or insufficiently processed fibers can be avoided.

Provision can also be made so that at least two discharge elements are arranged symmetrically in the circumferential direction and/or radial direction relative to the moveable processing body.

Through the arrangement of several discharge elements with a common processing body, each forming a processing area, the throughput of substance mixture can be significantly increased. This is especially advantageous as, if necessary, during operation one or more discharge elements can be relatively easily "switched on/off" and maintenance work on individual discharge elements is possible. In addition, this measure can be used to minimize or even fully compensate for the any bending moments applied to the processing body by the process pressure and/or contact pressure. This enables a more stable and lower maintenance work device.

In addition, provision can be made so that at least one second discharge element is arranged essentially opposite to a first discharge element, whereby the first discharge element is assigned to a first surface of the moveable processing body and the corresponding second discharge element is assigned to a second surface lying opposite to the first surface.

Through the use of several discharge elements that, with a processing body, each form a processing area, the throughput of the substance mixture can be significantly increased. Through the opposing arrangement of two corresponding discharge elements, a reduction of the bending moments, up to the full compensation of the bending moments, on, for example, the drive shaft of the processing body or also the processing body itself, can be achieved. This measure can be advantageous with both band-shaped processing bodies and rotationally symmetrical processing bodies such as a cylinder or a disc as long as the substance mixture-affected partial surface of the corresponding discharge elements essentially lie opposite the first and second surfaces.

Furthermore, provision can be made so that at least two discharge elements are arranged along the direction of movement and/or normal to the direction of movement of moveable processing bodies.

It is also conceivable here that the discharge elements are staggered, that is mounted offset to each other, in at least one direction. The arrangement of several discharge element enables higher productivity simply through the use of a common processing body. This advantage, analogous to the aforementioned arrangement of the discharge elements lying opposite each other to the first and second surfaces, should be seen above all therein that the power consumption for the drive of the moveable processing body increases only slightly or even negligibly. Thus, a large amount of substance mixture can be simultaneously processed very energy efficiently and cost effectively. It is, therefore, easy to imagine that several discharge elements can be arranged around a cylinder or also a cone. Thereby, the discharge elements can basically also be arranged opposite the first surface, that is, for example, an outer surface of the cylinder, through which compensation of the bending moments on the drive shaft of the processing body can be achieved. It is likewise conceivable to arrange the discharge elements in the circumferential direction of a disc, which has the same effect on the disc.

Especially advantageous, too, is an arrangement in accordance with which it can be provided that at least the moveable processing body is sealed off from the drive unit by a housing by means of at least one contacting and/or contact-free sealing component, preferably a maintenance-free labyrinth seal.

Due to the relatively simple design of the invention-related device, complex sealing solutions can be dispensed with. The processing of the substance mixture takes place under the effects of a process pressure, however, as a rule the substance mixture after discharge is exposed simply to atmospheric conditions. A housing that at least shields the substance-mixture-affected partial surface, preferably the entire processing body against the environment, is advantageous for the collection of the processed substance mixture. For the sealing of the housing openings, such as the discharge elements or a drive shaft, simple, contacting rubber seals, for example, can be used or also self-sealing, maintenance-free labyrinth seals as they are known to the specialist. This enables especially long maintenance intervals and low manufacturing costs.

It has proven to be an advantage when the housing is allocated a collection tank for the collection and/or further processing of the processed substance mixture. In certain cases, the essentially complete sealing of the housing is beneficial in order to put the processing area under negative or positive pressure or also to form a protective gas atmosphere in it, whereby the quality of the processed substance mixture is specifically influenced.

According to further study, it is possible that before the delivery of the substance mixture, a chemical and/or enzymatic and/or mechanical pre-treatment of the substance mixture is carried out, preferably during the course of a grinding process in a refiner.

Through a chemical and/or enzymatic pre-treatment, the separation of the fiber constituents can be specifically influenced, whereby the disintegrating to nanofibers, especially nanocellulose, can be made easier. Such a pre-treatment can be carried out in an external device or even in a section of the supply equipment intended for this. Equally conceivable is a mechanical pre-treatment for the setting of a predeterminable fiber length and/or dispersion of the fiber lengths and/or diameters, that, for example, can be carried out through the refiner and associated processes known to the specialists. Thus, a suitable pre-treatment can be used to improve the quality of the processed substance mixture.

In addition, it can also be useful if at least the process steps of the pressing through and processing of at least parts of the processed substance mixture are repeated.

Through the repeated processing of the fiber-containing substance mixtures, the quality and homogeneity of the processed substance mixture can be increased. In doing so, it is conceivable of feeding at least parts, or even the entire quantity, of the processed substance mixtures through the device again. In the process, a circulation system between the collection tank and the supply unit can be quite simply used for this in order to achieve a predetermined fiber diameter and/or length dispersion. In certain cases, it can be advantageous to adjust the liquid components of the processed and of the reprocessing-intended substance mixture, by, for example, adding water. Through this, a particularly fine pulping of the fiber constituents to nanofibers, especially nanocellulose, with relatively low energy and/or pressure expenditure can be achieved.

BRIEF DESCRIPTION OF THE DRAWINGS

For better understanding of the invention, it is explained in more detail by means of the following figures.

There is shown in a highly simplified, schematic representation in.

DETAILED DESCRIPTION

Figure 1:
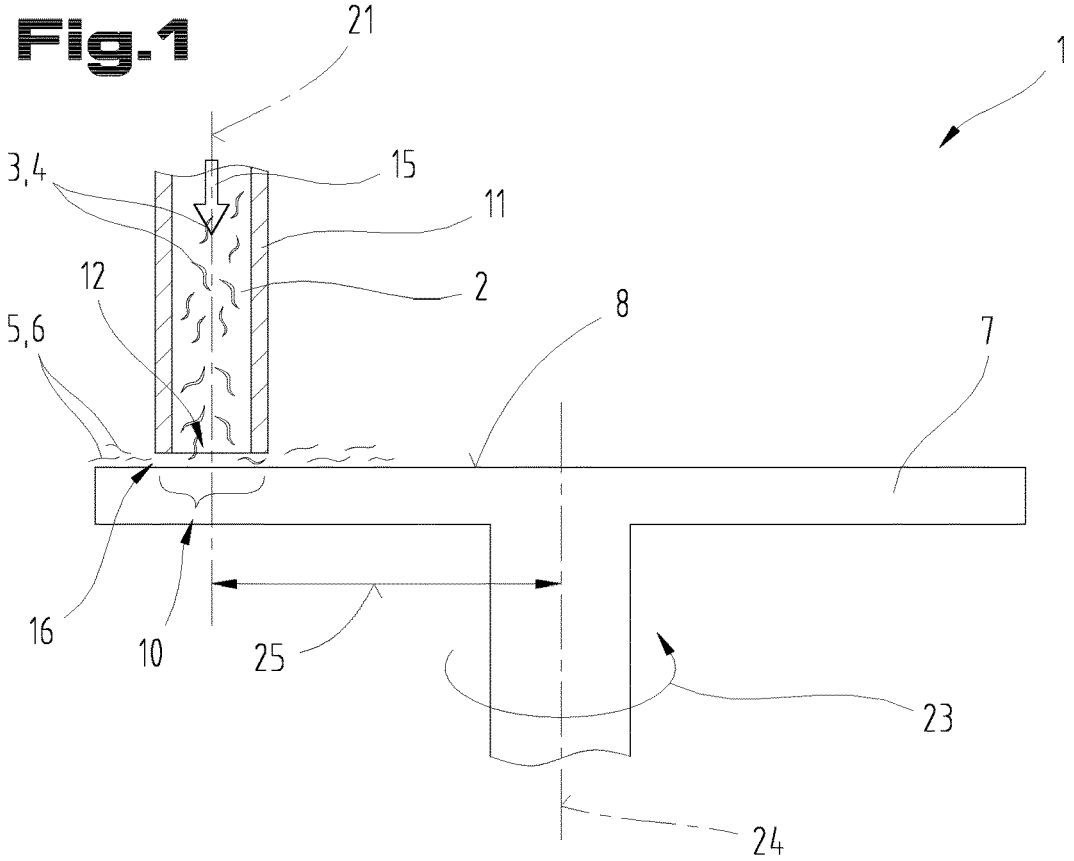
FIG. 1 is a schematic cross-section representation through a discharge element and a processing body for explanation of the operating principle.

To begin with, it should be noted that in the differently described configurations the same components are given the same reference characters and/or the same component designations, whereby the disclosures contained in the complete description can be logically transferred to the same parts with the same reference characters and/or the same component designations. Also, the position specifications chosen in the description, such as, for example, up, down sideways, etc., refer to the directly described and illustrated figure and these position specifications must be transferred logically to the new positions in the event of a change of position.

In FIG. 1, a device 1 for the production of nanofibers 5, especially of nanocellulose 6, from a fiber-containing 3, especially pulp 4, substance mixture 2 is schematically represented. The principle of the disintegrating of the fiber-containing substance mixture 2 can be seen from the cross-section illustration. In accordance with the invention, a moveable processing body 7 is arranged relative to at least one opposite lying discharge element 11. Between the discharge element 11 and a substance mixture-affected partial surface 10 of the moveable processing body 7, a slit-like processing area 16 is formed.

Figure 6:
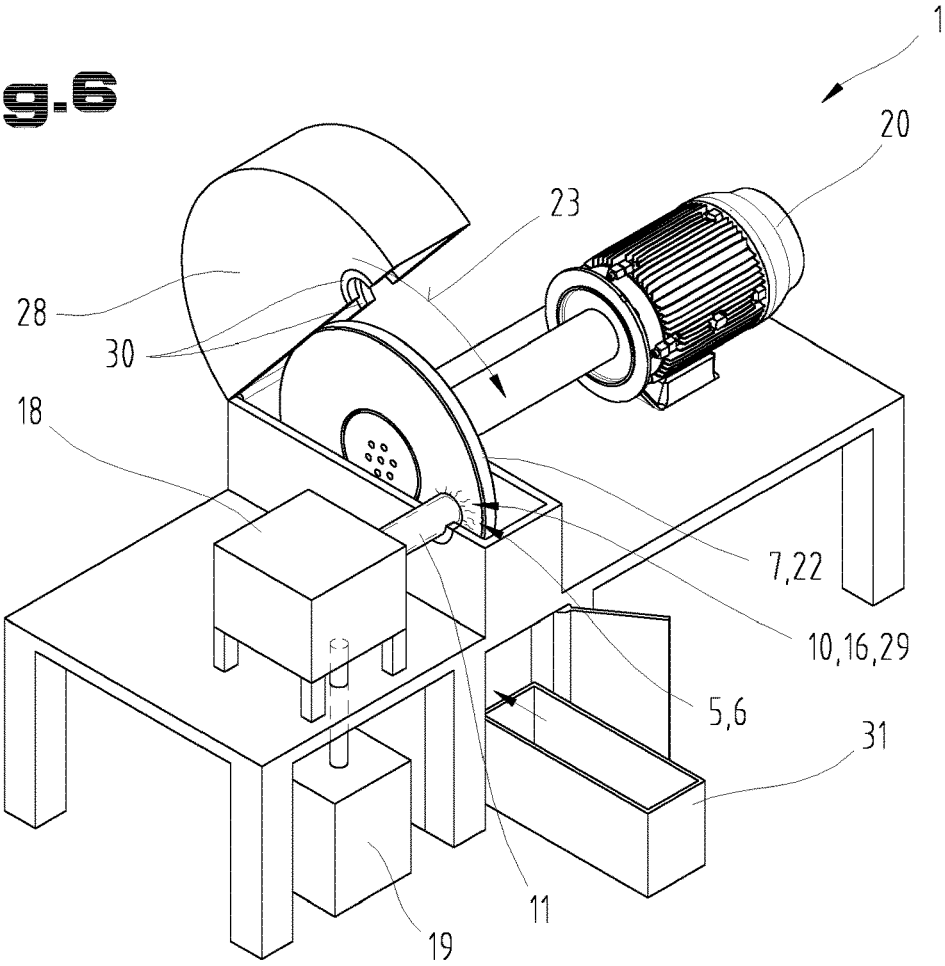
FIG. 6 is a schematic overview presentation of a possible arrangement of a device for the production of nanofibers.

As schematically represented in FIG. 1, the substance mixture 2 includes a liquid component as well as fibers 3, which can consist especially of pulp 4 or cellulose. The substance mixture 2 is pressed through the discharge element 11 at a predeterminable process pressure 15. In the process, the moveable processing body 7 can, for example, be passively moved in a relative movement through the discharge of the processed substance mixture 2 out of the processing area 16 in a direction of movement 23. Likewise, the processing body 7 can be actively moved, for example, as shown in FIG. 6, in the direction of movement 23 by a drive unit 20. On the passage of the fiber-containing 3 substance mixture 2 through the discharge element 11, the shear forces occurring in the slit-like formed processing area 16 are utilized for the disintegrating of the fibers 3, especially of the pulp 4 to nanofibers 5, especially nanocellulose 6.

The example configuration in FIG. 1 represents a processing body 7 formed as a disc 22. In this case, the processing body 7 is rotatable about a rotation axis 24 and/or flexibly mounted. The discharge element 11 has a discharge element axis 21, that essentially corresponds to an imaginary longitudinal axis through the discharge element 11 in the center of the discharge opening 12. As can be seen particularly clearly from the integrated view of FIG. 1 with FIG. 2, the relative speed 27 in the processing area 16 can be set through the radial distance 25 between the discharge element axis 21 and the rotation axis 24.

Figure 2:
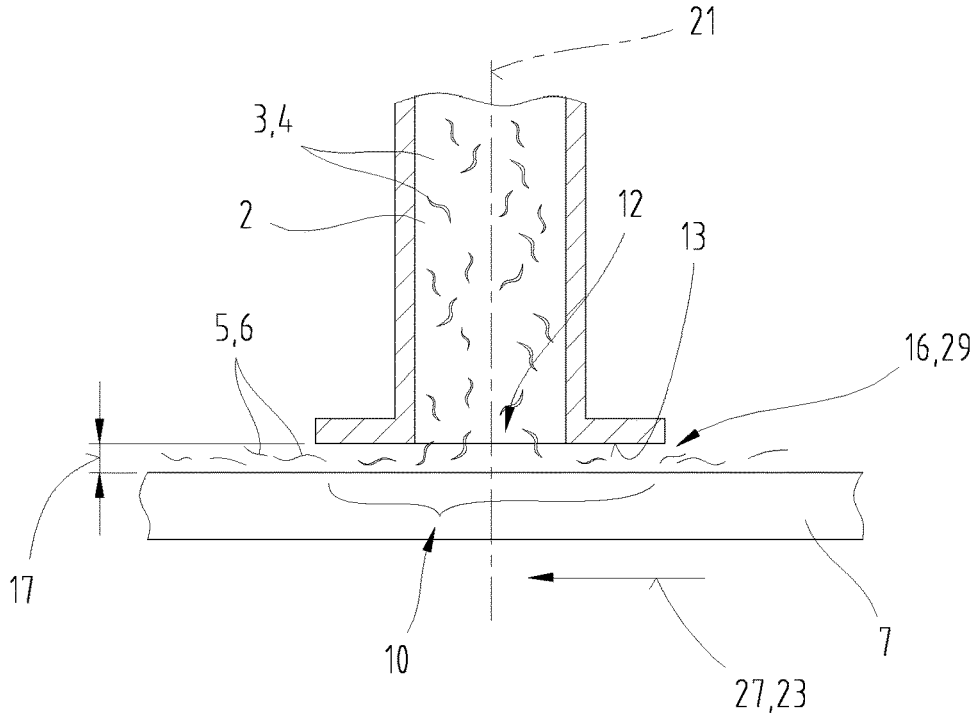
FIG. 2 is a schematic cross-section representation through a discharge element with a functional surface and a processing body for explanation of the operating principle.

It can be seen from the integrated view of FIG. 1 with FIG. 2 up to FIG. 6 that in the direction of movement 23, the moveable processing body 7 is passed by at the discharge element 11. This relative movement takes place preferably primarily sideways, especially preferred normal to a discharge element axis 21.

FIG. 2 shows a further and possibly independent design of the invention-related device. In this design, the discharge element 11 has at least in part a functional surface 13 surrounding the discharge opening 12. As shown, the functional surface 13 can be formed in one piece with the discharge element 11. It is, however, conceivable that the functional surface 13 can be attached to the discharge element 11 as a part of an end section 14 or also as a separate component in order to ensure simple exchangeability. On the passing and/or pressing of the substance mixture 2 through the discharge element 11, a hydrodynamic bearing 29 can be formed in the processing area 16. In this case, the processing area 16 includes the functional surface 13 and the corresponding opposite lying substance-affected partial surface 10. Through the formation of a fluid wedge in the hydrodynamic bearing 29, the contact of the discharge elements 11 and/or the functional surface 13 with the processing body 7 can be avoided.

It can also be seen in FIG. 2 that the discharge element 11 has an operating distance 17 from the substance mixture-affected partial surface 10. Such an operating distance 17 can likewise be set for the device schematically represented in FIG. 1.

An example of the configuration of a positioning device 18 for the positioning of the discharge element 11 is shown in FIGS. 3*a*-4*c* and FIG. 6 and is logically transferable to FIGS. 1, 2 and 5*a*-5*d*. As is especially evident in the FIGS. 3*a* and 3*b*, the positioning device 18 can be used to move the at least one discharge element 11 in the direction of the processing body 7 and/or at right-angles to this. Such a positioning device 18 can be used especially for the setting of the operating distance 17.

Figure 3A:
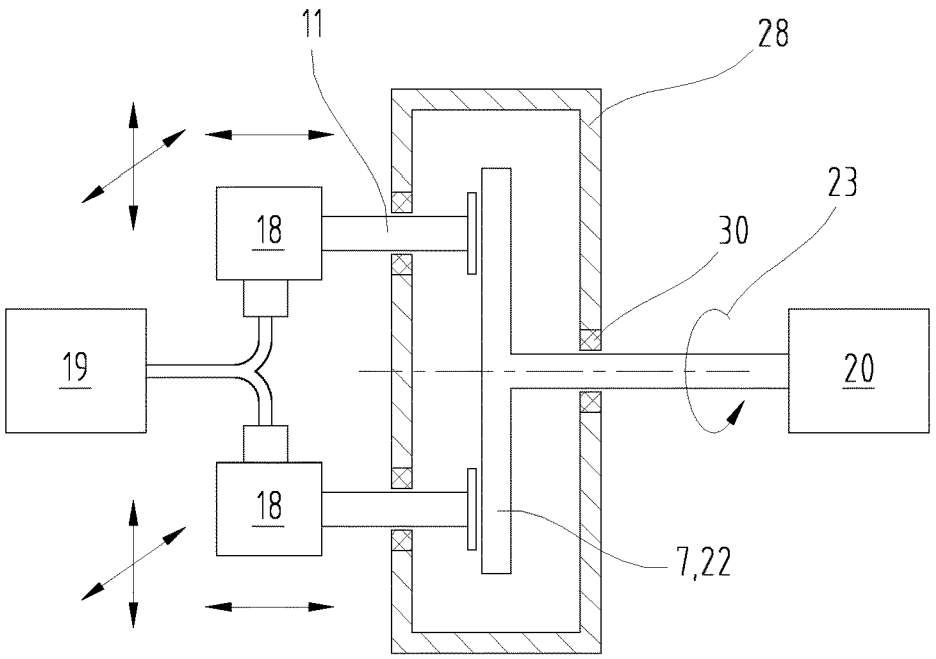
FIGS. 3*a*-3*b* are schematic cross-section representation of possible design shapes of the device with two discharge elements that are allocated spaced in the circumferential direction to a first surface (a) and allocated to a first and second surface lying opposite (b)
Figure 3B:
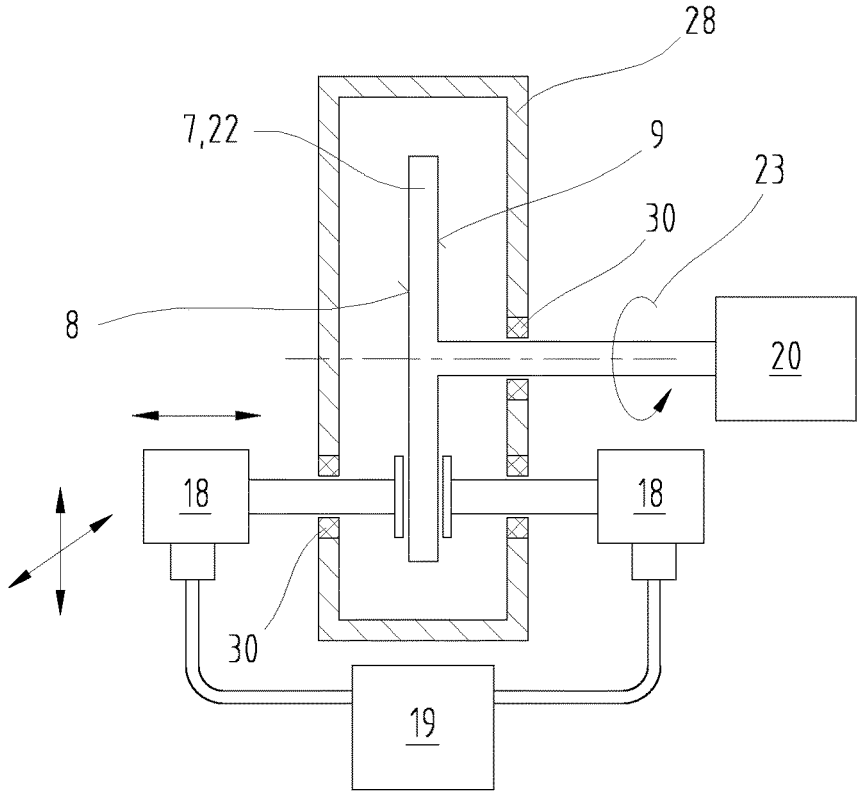
Figure 4A:
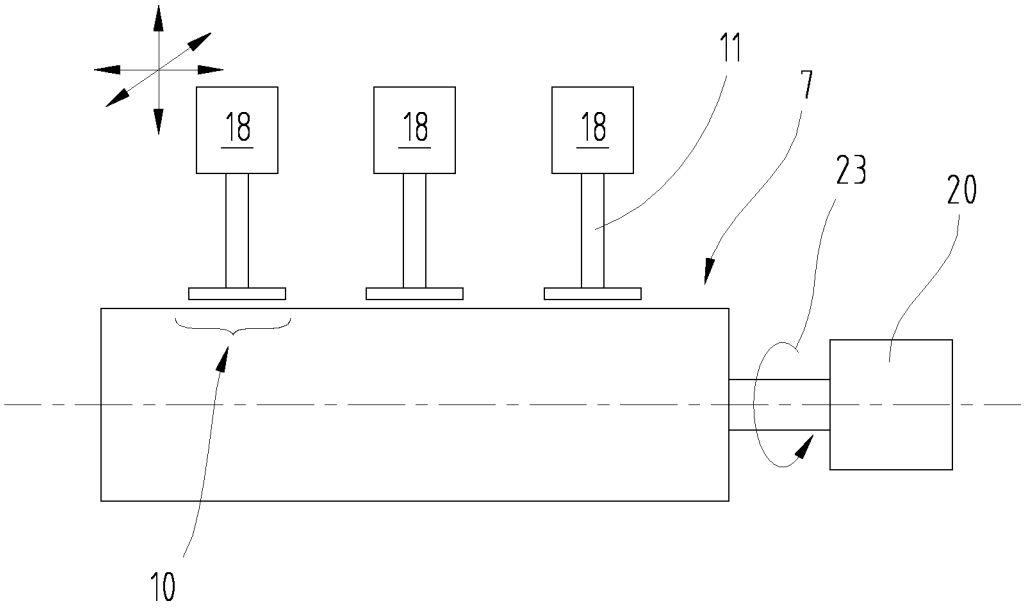
FIGS. 4*a*-4*c* are schematic cross-section representation of processing bodies as cylinders (a), cones (b) and band (c) with several discharge elements.
Figure 4B:
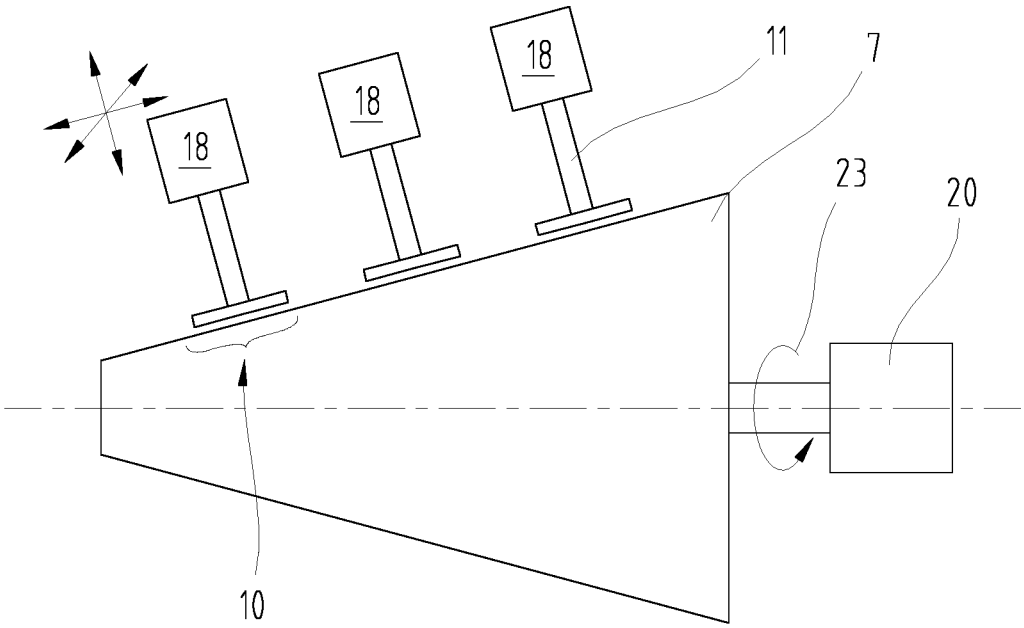
Figure 4C:
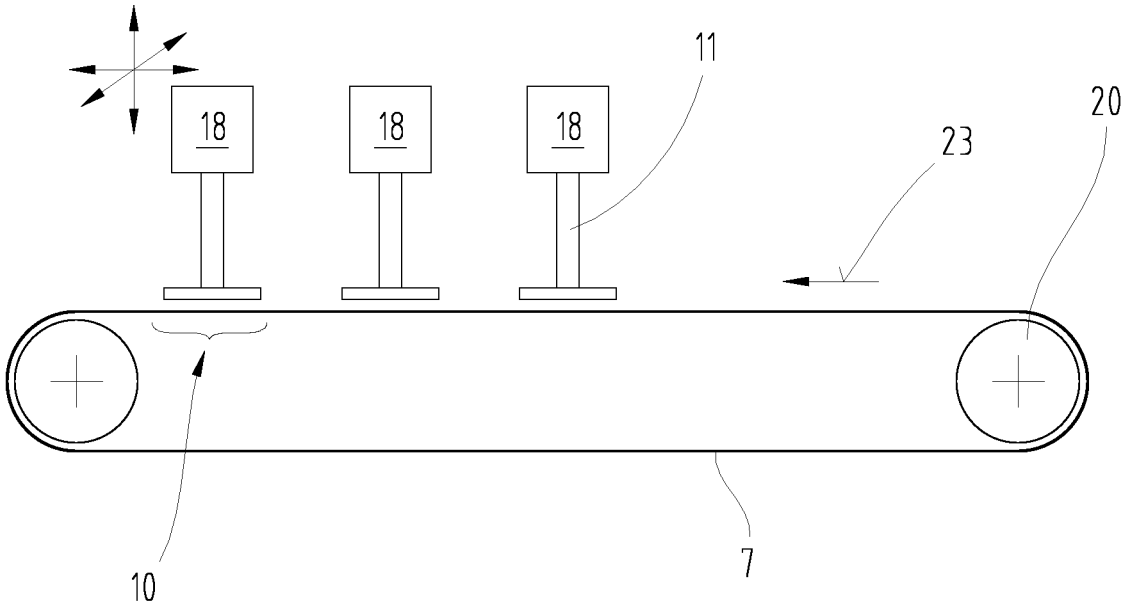

In FIGS. 3*a, b* as well as in FIGS. 4*a* to 4*c*, devices 1 are schematically represented in which two or more discharge elements 11 are arranged relative to a processing body 7. Here, FIG. 3*a* shows two discharge elements 11 that are spaced apart from a first surface area 8 of the processing body 7 symmetrically from the rotation axis 24. In FIG. 3*b* a situation is schematically represented whereby two discharge elements lying essentially opposite and symmetrical to each other are arranged on a first surface area 8 respectively a second surface area 9 of the processing body 7. Through the design of the processing body 7 as a disc 22, in the designs represented in FIGS. 3*a* and *b* any bending moments on the disc 22 and thereby on the rotation axis can be compensated.

The feeding of the at least one discharge element 11 can in each case be achieved via a separate feeding device 19 or also via a common feeding device 19 for the supply of the fiber-containing 3 substance mixtures 2. For reasons of simplicity, the representation of such a feeding device 19 is dispensed with in FIGS. 1, 2, 4*a*-4*c* and 5*a*-5*d*.

The moveable processing body 7 can be formed invention-related as a rotationally symmetrical body such as a cylinder, a drum, a cone or a disc 22, as schematically represented in FIGS. 4*a*, 4*b* and 3*a*-3*b*. As an alternative, it is possible to form the moveable processing body 7 band-shaped, for example, as a chain or a belt as schematically shown in FIG. 4*c*. Especially in FIGS. 3*a*-3*b* and 4*a*-4*c*, it can be seen that several discharge elements 11 can be allocated to a commonly used processing body 7. In doing so, the moveable processing body 7 can be connected to a drive unit 20, as can be seen in FIGS. 3*a*-3*b*, 4*a*-4*c* and 6. Such a drive unit 20 can, for example, be configured as a hydraulic or pneumatic motor and, especially preferable, as an electric motor and be provided with a speed control.

The positioning device 18 schematically represented in FIGS. 3*a*-3*b*, 4*a*-4*c* and 6 can be formed as adjustable and/or positionable for the setting of the operating distance 17 and/or a solid angle 26 between the at least one discharge element 11 and the substance mixture-affected partial surface 10 of the moveable processing body. It is likewise imaginable, that by means of a common positioning device 18 several discharge elements 11 can be positioned together relative to the processing body. In addition, it can be seen in FIGS. 3*a*-3*b* and 4*a*-4*c* that at least two discharge elements 11 can be arranged in the circumferential direction and/or radial direction relative to the moveable processing body 7. In doing so, the discharge elements 11 can be arranged symmetrically and/or off set to each other on a first surface 8 and/or a second surface 9.

Not illustrated is a special configuration of cylinders, cones, belts or chains in which at least one second discharge element 11 is arranged essentially opposite a first discharge element 11 whereby the first discharge element 11 is allocated to a first surface area 8 of the moveable processing body 7 and the corresponding, second discharge element 11 is allocated to the second surface area 9 lying opposite the first surface area 8. This situation is discernible from FIG. 3*b* for a processing body 7 formed as a disc and can be extrapolated by a specialist to other rotationally symmetrical and/or band-shaped processing bodies 7.

In FIGS. 5*a* to 5*d*, several discharge elements 11 in different possible configurations are shown.

Figure 5A:
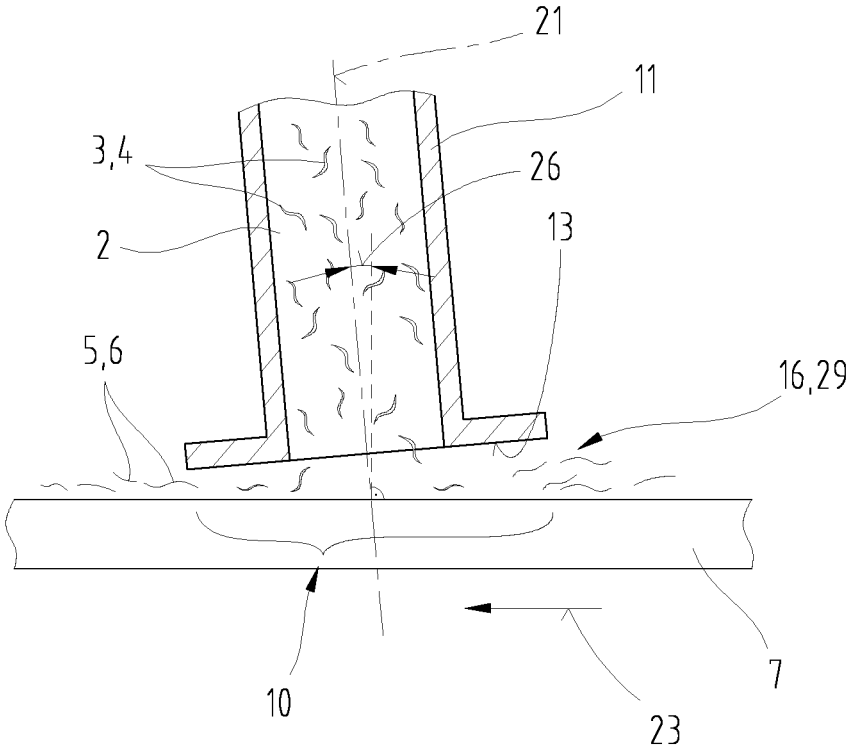
FIGS. 5*a*-5*d* are schematic representation of a discharge element in cross-section tilted at a solid angle (a), with a flexible end section (b), with a form-matching functional surface (c), and in a bottom view (d)

Here, FIG. 5*a* shows a discharge element 11 the discharge axis 21 of which is arranged at a preferred, predeterminable solid angle relative to the perpendicular of the substance mixture-affected partial surface 10 of the processing body 7. Such a positioning of the discharge element 11 can be carried out by means of a positioning device 18 as previously explained. From this schematic representation, the formation of a hydrodynamic bearing 29 can also be clearly seen.

Figure 5B:
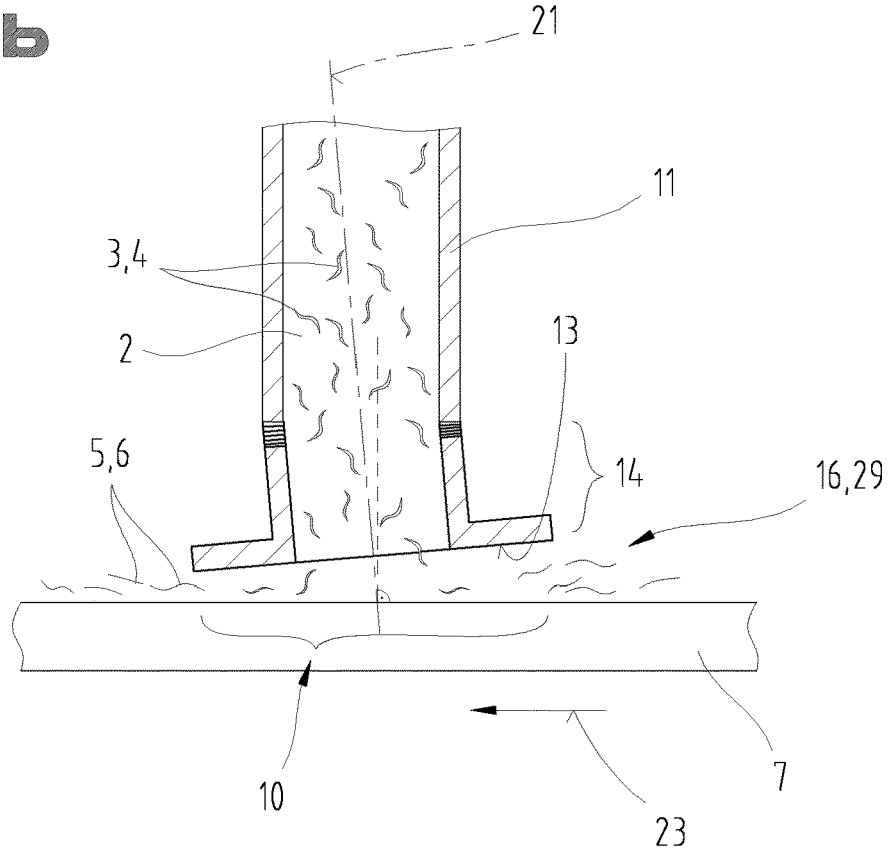

Another example of a discharge element 11 is shown schematically in FIG. 5*b*, wherein an end section 14 of the discharge element 11 facing the substance mixture-affected partial area 10 is at least partially flexibly mounted.

In this way, a type of floating bearing of the end section 14 can be formed during the formation of the hydrodynamic bearing 29 without causing the jamming or clogging of the end section 14.

Figure 5C:
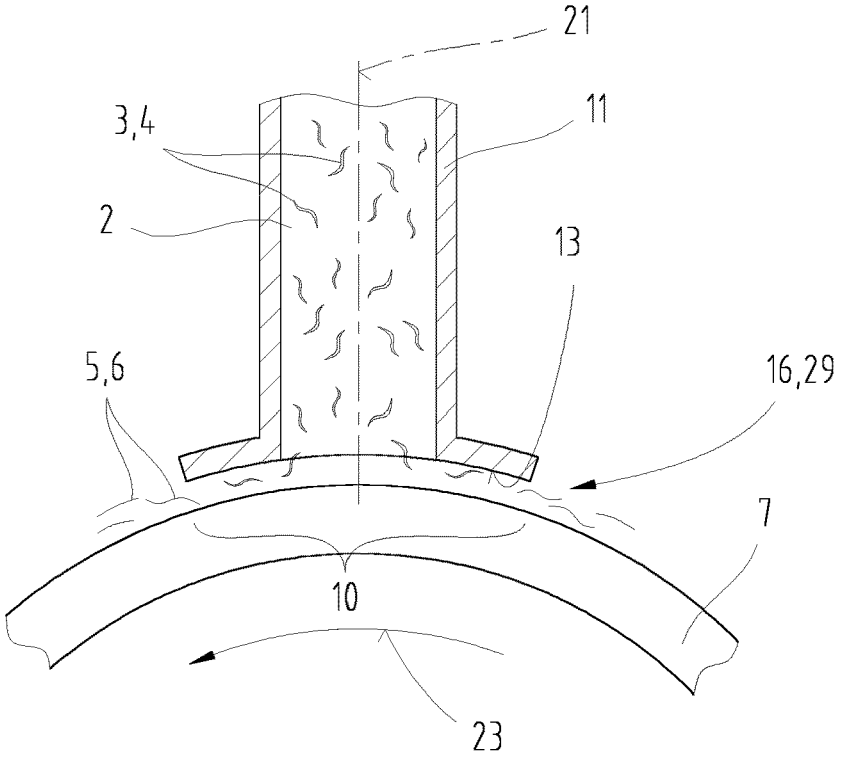

FIG. 5*c* shows a schematic sectional view through a discharge element 11, one discharge element opening surrounding functional surface 13 and a curved surface processing body 7. The functional surface 13 is essentially formed shape-complementary to the substance mixture-affected partial surface 10 of the processing body 7. Thereby, especially concave and convex shapes of the functional surface 13 are conceivable, as is especially clearly evident in FIG. 5*c*.

Figure 5D:
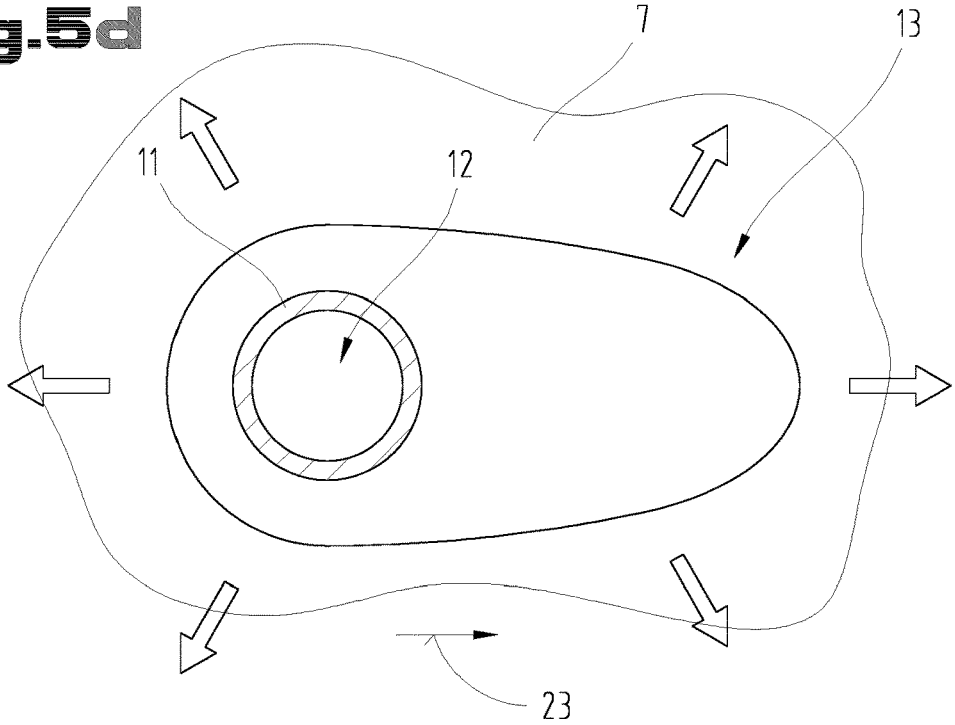

In FIG. 5*d*, another possible configuration of a discharge element 11 and a functional surface 13 is suggested schematically in a bottom view. Thereby, the functional surface 13 is formed with a larger longitudinal extension in the direction of movement 23 than in the cross section and/or against the intended direction of movement 23. The motion arrows shown indicate schematically the homogenous discharge of the processed substance mixture 2. When using such a shaped functional surface 13, the shape can be optimized by a specialist for the respective application and the geometry of the processing body 7. The processing area 16 should, as previously explained, essentially be formed between the functional surface 13 and the corresponding substance mixture-affected partial surface 10.

According to the invention, the discharge elements 11 and their combination shown in FIGS. 5*a* to 5*d* can be included in the descriptions of FIGS. 2, 3*a*-3*b*, 4*a*-4*c* and 6 and for reasons of brevity are not discussed separately but are referenced to the appropriate discussions.

FIG. 6 shows a general schematic view of the invention-related device 1. Here there is simply a discharge element 11 aligned relative to the moveable processing body 7. The positioning of the discharge element 11 is done by means of a positioning device 18. The feeding of the substance mixture 2 takes place via a feeding device 19. The processing body 7 formed as a disc 22 is driven in the direction of movement 23 by a drive unit 20.

As can be seen from FIG. 6, the device 1 has a housing 28 that is shown in the open state. The housing 28 serves for substance capture during processing and can be sealed off from at least the drive unit 20 by means of one or more sealing elements 30. Examples of such sealing elements 30 can also be seen in FIGS. 3*a*-3*b* and can be formed as contact or also non-contact. The processed substance mixture 2 can be collected in a collection tank 31. It is also conceivable that the feeding device 19 can be connected to the collection tank 31 in order to create a circulation principle.

Within the scope of the present invention, the individual process steps can also be automated and preferably, be controlled by a central, not illustrated, system controller. In addition, operation by means of a control panel or also a touchscreen for the monitoring and control of the system is envisaged.

The setting of a predeterminable dispersion of fiber lengths and/or fiber cross-sections and/or their distribution can be specified by the user and be controlled by means of a system controller. The repeated throughput of at least parts of the processed substance mixture 2 can also be used for the setting of the homogeneity and/or quality of the nanofibers 5 respectively, nanocellulose 6.

The consistency of the substance mixture 2 can have an influence on the quality of the processed substance mixture 2. With the present device 1 and the corresponding processes, suspensions, that is, substance mixtures 2, with a fiber content of 0.1 to approx. 10 vol. %, preferably 1 to approx. 8 vol. %, can be reliably and easily processed. Consistencies up to 25 vol. % and over are also conceivable. Here, under certain circumstances, it may be necessary that the specialist falls back on suitable feeding devices 19 that are capable of delivering substance mixtures 2 with such high consistencies under the application of a sufficiently high process pressure 15. Especially suitable for this are, for example, high pressure feed screw configurations.

The embodiments show possible design variants, whereby at this point it is noted that the invention is not limited to the specific design variants described, in fact much more is possible, even various combinations of the individual design variants with each other, and this possibility of variation is due to the teaching of technical action through objective creation lying in the skills of the specialist active in this technical area.

The scope of protection is determined by the claims. The description and the drawings, however, must be used for the interpretation of the claims. Individual features or feature combinations from the illustrated and described various embodiments can represent stand-alone, innovative solutions. The underlying task for the stand-alone innovative solutions can be taken from the description.

All information about the value ranges in the representational description should be understood to include any and all sub-areas thereof, for example, the specification 1 to 10 must be understood to include all sub-areas starting from the lower limit 1 and the upper limit 10, this means that all sub-areas start with a lower limit, 1, or greater and end at an upper limit of 10 or less, for example, 1 to 1.7, or 3.2 to 8.1 or 5.5 to 10.

For the sake of good order, it should be noted that for better understanding of the design, some elements have been illustrated not to scale and/or enlarged and/or scaled down.

REFERENCE CHARACTER LIST

1 Device
2 Substance mixture
3 Fiber
30 Sealing element
31 Collection tank
4 Pulp
5 Nanofiber
6 Nanocellulose

7 Processing body
8 First surface
9 Second surface
10 Substance mixture-affected partial surface
11 Discharge element
12 Discharge opening
13 Functional surface
14 End section
15 Process pressure
16 Processing area
17 Operating distance
18 Positioning device
19 Feeding device
20 Drive unit
21 Discharge element axis
22 Disc
23 Direction of movement
24 Rotation axis
25 Radial distance
26 Solid angle
27 Relative speed
28 Housing
29 Hydrodynamic bearing

The invention claimed is:

1. A device for the production of nanofibers from a fiber-containing substance mixture, the device including:

at least one discharge element with a discharge opening, for the outlet of a fiber-containing substance mixture;

at least one feeding device for the supply of the fiber-containing substance mixture at the discharge element with a predeterminable process pressure;

at least one positioning device for the positioning of the at least one discharge elements; and a moveable processing body for disintegrating of the fiber-containing substance mixture is arranged opposite relative to at least one discharge element, wherein on the outlet of the fiber-containing substance mixture through the discharge element a slit-like processing area between the discharge element and a substance mixture-affected partial area of the moveable processing body is formed.

2. The device according to claim 1, wherein the moveable processing body is formed to be driveable, by means of a drive unit, in a direction of movement, primarily sideways to one of the discharge element axes of the discharge element.

3. The device according to claim 1, wherein the moveable processing body is formed as a disc rotatable sideways to the discharge element.

4. The device according to claim 3, wherein the at least one positioning device is formed moveable parallel to a rotation axis of the disc, for the setting of a predeterminable radial distance of the discharge element axis from the rotation axis.

5. The device according to claim 1, wherein the discharge element is formed with at least in part a functional surface surrounding the discharge opening for the formation of a hydrodynamic bearing in the processing area.

6. The device according to claim 5, wherein the functional surface is formed with a larger longitudinal extension in the direction of movement than in the cross section and/or against the direction of movement.

7. The device according to claim 5, wherein the functional surface is formed essentially complementary in shape to the substance mixture-affected partial surface of the moveable processing body.

8. The device according to claim 1, wherein the at least one discharge element is formed adjustable to a predeterminable solid angle of the discharge element axis relative to the surface area of the moveable processing body.

9. The device according to claim 1, wherein the at least one positioning device is formed adjustable for the setting of an operating distance and/or a solid angle (26) between the at least one discharge element and the substance mixture-affected partial surface of the moveable processing body.

10. The device according to claim 1, wherein an end section of at least one discharge element is mounted at least partially moveable relative to the opposite lying substance mixture-affected partial surface.

11. The device according to claim 1, wherein at least two discharge elements are arranged symmetrically in the circumferential direction and/or the radial direction relative to the moveable processing body.

12. The device according to claim 1, wherein at least one second discharge element is arranged essentially opposite a first discharge element, wherein the first discharge element is allocated to a first surface area of the moveable processing body, and the corresponding, second discharge element is allocated to the second surface area lying opposite the first surface area.

13. The device according to claim 1, wherein at least two discharge elements are arranged along the direction of movement and/or normal to the direction of movement of the moveable processing body.

14. The device according to claim 2, wherein at least the moveable processing body is sealed off from the drive unit by a housing by means of a contacting and/or contact-free sealing component.

15. A process for the production of nanofibers from a fiber-containing substance mixture, the process including moving a moveable processing body relative to at least one discharge element at a predeterminable relative speed;

pressing a substance mixture through the at least one discharge element at a predeterminable process pressure, wherein the substance mixture includes at least one liquid component and fibers;

processing the substance mixture through a formation of a slit-like processing area for disintegrating of fibers between the discharge element and a substance mixture-affected partial surface of the moveable processing body through the positioning of the discharge element relative to the moveable processing body.

16. The process according to claim 15, wherein the moveable processing body is moved, by means of a drive unit, in a direction of movement, primarily sideways to one of the discharge element axes of the discharge element.

17. The process according to claim 15, wherein at least one discharge element with a discharge opening formed with at least in part a functional surface is used for the formation of a hydrodynamic bearing between the discharge element and a substance mixture-affected partial surface.

18. The process according to claim 15, wherein the relative speed of the processing body moved for the setting of the shear forces formed in the slit-like processing area is controlled.

19. The process according to claim 15, wherein an operating distance between the at least one discharge element and the corresponding substance mixture-affected partial surface for the setting of compressive forces on the moving processing body is controlled by means of at least one positioning device.

20. The process according to claim 15, wherein a solid angle of a discharge element axis of at least one discharge element is controlled by means of at least one positioning device.

* * * * *